US009106990B2

(12) United States Patent
Nyu et al.

(10) Patent No.: US 9,106,990 B2
(45) Date of Patent: Aug. 11, 2015

(54) FAILURE DETECTION DEVICE FOR VEHICLE SPEAKER

(75) Inventors: Yasunori Nyu, Kariya (JP); Akito Itou, Kariya (JP)

(73) Assignee: DENSO CORPORATION, Kariya (JP)

( * ) Notice: Subject to any disclaimer, the term of this patent is extended or adjusted under 35 U.S.C. 154(b) by 321 days.

(21) Appl. No.: 13/615,959

(22) Filed: Sep. 14, 2012

(65) Prior Publication Data

US 2013/0070932 A1 Mar. 21, 2013

(30) Foreign Application Priority Data

Sep. 17, 2011 (JP) ..... 2011-203889

(51) Int. Cl.
*H04R 29/00* (2006.01)
*H04R 3/00* (2006.01)

(52) U.S. Cl.
CPC ..... *H04R 3/007* (2013.01); *H04R 29/001* (2013.01); *H04R 2499/13* (2013.01)

(58) Field of Classification Search
None
See application file for complete search history.

(56) References Cited

U.S. PATENT DOCUMENTS 5,291,183 A * 3/1994 Chiang ..... 340/692
5,345,510 A * 9/1994 Singhi et al. ..... 381/77

FOREIGN PATENT DOCUMENTS

| | | |
|---|---|---|
| JP | 11-187495 | 7/1999 |
| JP | 2002-23761 | 1/2002 |
| JP | 2003-274491 | 9/2003 |
| JP | 2007-37024 | 2/2007 |
| JP | 2011-70561 | 4/2011 |

OTHER PUBLICATIONS

U.S. Appl. No. 13/616,115 of Itou, filed Sep. 14, 2012.

* cited by examiner

*Primary Examiner* — Daniell L Negron
(74) *Attorney, Agent, or Firm* — Nixon & Vanderhye P.C.

(57) ABSTRACT

A failure detection device for a vehicle speaker includes a signal generator, an amplifier, a coupling capacitor, a supply circuit, a detection circuit, and a determination section. The signal generator generates a sound signal corresponding to sound outputted from the speaker. The amplifier amplifies the sound signal. The capacitor supplies the amplified sound signal to the speaker. The supply circuit supplies a direct-current test current to the speaker so that the test current does not flow through the capacitor by applying a test voltage to the speaker. The test voltage is higher than a voltage of the sound signal. The detection circuit detects a terminal voltage of the speaker. The determination section determines whether at least one of an open-circuit and a short-circuit occurs in the speaker based on the terminal voltage during application of the sound signal to the speaker.

11 Claims, 5 Drawing Sheets

FAILURE DETECTION DEVICE FOR VEHICLE SPEAKER

CROSS REFERENCE TO RELATED APPLICATION

This application is based on Japanese Patent Application No. 2011-203889 filed on Sep. 17, 2011, the disclosure of which is incorporated herein by reference.

TECHNICAL FIELD

The present disclosure generally relates to failure detection devices for a vehicle speaker and in particular relates to a failure detection device for a vehicle speaker that outputs an operation notification sound for notifying a person that a vehicle is in an operating status.

BACKGROUND

JP-2002-23761A discloses a drive circuit connected to a sound generating body and having an error determination circuit for detecting an open-circuit in the sound generating body. The error determination circuit measures a current and a voltage of a magnetic coil of the sound generating body.

JP-2003-274491A discloses an open-circuit detection device for detecting an open-circuit in a speaker. The open-circuit detection device includes an equivalent circuit having equivalent impedance to the speaker circuit and detects the open-circuit by comparing an impedance of the equivalent circuit with an impedance of the speaker circuit.

JP-2007-37024A discloses a speaker line testing device for detecting an open-circuit and a short-circuit in a speaker circuit by measuring an impedance of the speaker circuit.

JP-2011-70561A discloses an alarm device including a switch. The switch connects a circuit, which supplies a detection voltage used for open-circuit detection in a piezoelectric sound generating body, to the sound generating body, only when the open-circuit detection is performed.

The error determination circuit disclosed in JP-2002-23761A includes a current transformer and a voltage transformer on a line connected to the sound generating body. Therefore, it is difficult to reduce the number of parts, the size, and the cost of the error determination circuit.

The open-circuit detection device disclosed in JP-2003-274491A includes the equivalent circuit and a switch circuit. Therefore, it is difficult to reduce the number of parts, the size, and the cost of the open-circuit detection device. Further, the open-circuit detection device cannot detect a failure such as an open-circuit during normal operation.

The testing device disclosed in JP-2007-37024A includes a detection circuit for detecting a current in a speaker line. Therefore, it is difficult to reduce the number of parts, the size, and the cost of the testing device. Further, in the testing device, an alternating current (AC) signal of an inaudible frequency range is mixed with an audible signal. Therefore, the testing device requires an AC signal generator. Further, in the testing device, a mixed signal of the audible signal and a test signal needs to be amplified.

In the alarm device disclosed in JP-2011-70561A, the detection voltage is supplied only when the detection is performed. Therefore, the alarm device cannot detect a failure such as an open-circuit during normal operation.

SUMMARY

In view of the above, it is an object of the present disclosure to provide a vehicle speaker failure detection device having a small number of parts and configured to perform failure detection during normal operation.

According to an aspect of the present disclosure, a failure detection device for a vehicle speaker includes a signal generator, an amplifier, a coupling capacitor, a supply circuit, a detection circuit, and a determination section. The signal generator generates a sound signal corresponding to sound outputted from the speaker. The amplifier amplifies the sound signal. The coupling capacitor supplies the amplified sound signal to the speaker. The supply circuit supplies a direct-current test current to the speaker so that the test current does not flow through the coupling capacitor by applying a test voltage to the speaker. The test voltage is higher than a voltage of the sound signal supplied from the coupling capacitor to the speaker. The detection circuit detects a terminal voltage on a terminal of the speaker. The determination section determines whether at least one of an open-circuit and a short-circuit occurs in the speaker based on the terminal voltage during application of the sound signal to the speaker.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

First Embodiment

Figure 1:
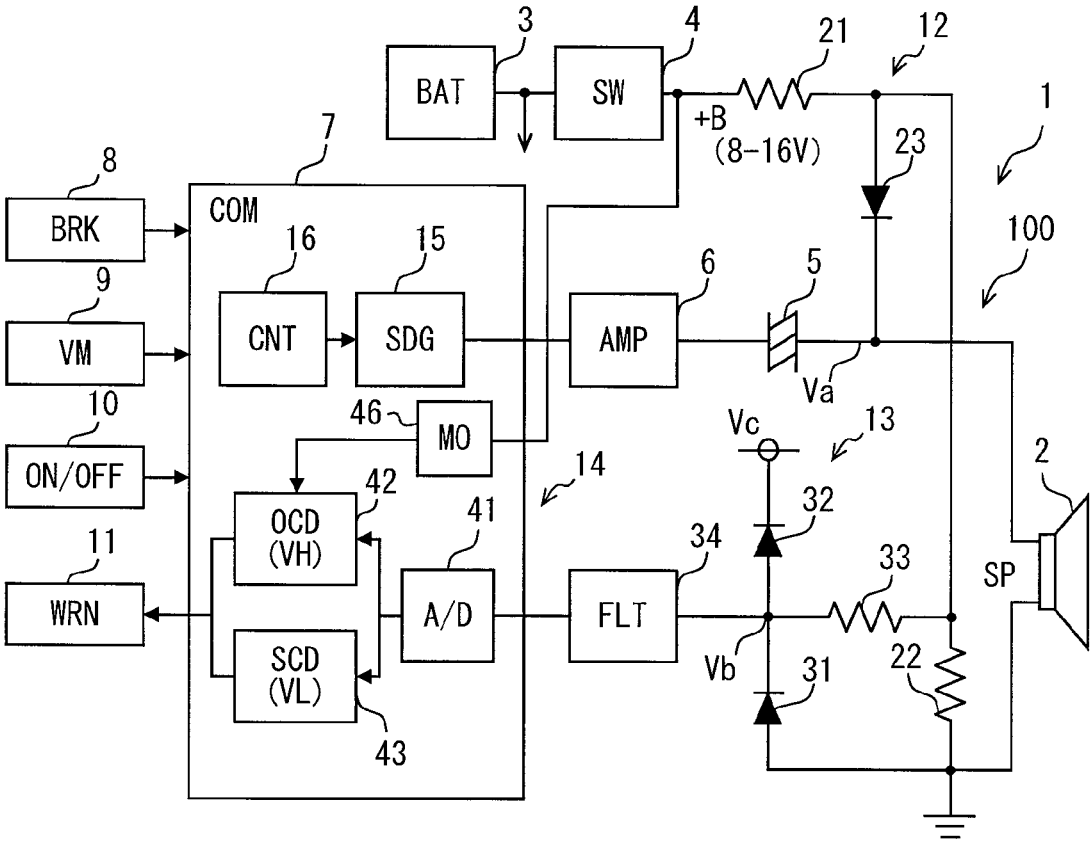
FIG. 1 is a block diagram of an operation notification sound generator including a failure detection device according to a first embodiment of the present disclosure.

FIG. 1 is a block diagram of an operation notification sound generator 1 including a failure detection device 100 according to a first embodiment of the present disclosure. The sound generator 1 is mounted on a vehicle and generates an operation notification sound designed to inform a person inside and outside the vehicle that the vehicle is in an operating state. The operating state can include a first operating state where the vehicle is running and a second operating state where the vehicle is ready to run. For example, when the vehicle is in the first operating state, the notification sound can inform a pedestrian of the presence of the vehicle, and when the vehicle is in the second operating state, the notification sound can inform an occupant of the vehicle that an engine of the vehicle is staring. Unlike a conventional horn device, the sound generator 1 continuously outputs the notification sound while the vehicle is running at a speed lower than a predetermined threshold. In addition, the sound generator 1 can continuously output the notification sound when the vehicle is temporarily stopped at a traffic light or the like.

For example, the sound generator 1 can be mounted on an electric vehicle, a hybrid electric vehicle, or a low-noise vehicle. The electric vehicle uses an electric motor to run. The hybrid electric vehicle uses both an electric motor and an internal-combustion engine to run. The low-noise vehicle uses an internal-combustion engine with a noise reduction function to run. If the sound generator 1 is mounted on the hybrid electric vehicle, the sound generator 1 can output the notification sound only when the hybrid electric vehicle is running by using only the electric motor.

The sound generator 1 has a speaker 2 (denoted as "SP" in the drawings) with a speaker circuit. The speaker 2 is mounted on the vehicle. The speaker 2 is a dynamic speaker with a voice coil. That is, the speaker 2 is an inductive device. A negative terminal of the speaker 2 is connected to a ground potential. A positive terminal of the speaker 2 is supplied with an alternating-current (AC) voltage for generating the notification sound. Further, the positive terminal of the speaker 2 is supplied with a direct-current (DC) voltage for testing the speaker 2.

The sound generator 1 is provided with a power source 3 (denoted as "BAT" in the drawings). The power source 3 is a battery mounted on the vehicle. The power source 3 serves as a power source for the sound generator 1. The power source 3 provides an activation voltage +B when a power switch 4 (denoted as "SW" in the drawings) is in an ON position. The activation voltage +B is supplied when the vehicle is in an activation state where there is a possibility that the vehicle runs. In other words, the activation voltage +B is not supplied when the vehicle is not in the activation state. The activation voltage +B can vary depending on a voltage of the power source 3. For example, when the power source 3 is a typical vehicle battery of 12V, the activation voltage +B can vary within a range from about 8V to about 16V. The sound generator 1 and the failure detection device 100 are designed so that they can operate normally within the variation range of the activation voltage +B.

The sound generator 1 includes a coupling capacitor 5 and a power amplifier 6 (denoted as "AMP" in the drawings). The power amplifier 6 amplifies a sound signal for the notification sound. The coupling capacitor 5 passes a predetermined AC component of an output of the power amplifier 6 to generate the notification sound. An output of the coupling capacitor 5 is inputted to the speaker 2. Thus, a voltage of the sound signal is applied through the coupling capacitor 5 to the speaker 2 from the power amplifier 6.

The sound generator 1 includes a controller 7 (denoted as "COM" in the drawings). The controller 7 is an electronic control unit including a microcomputer and a memory device readable by the microcomputer. The memory device stores programs. The microcomputer executes the programs stored in the memory device so that the controller 7 can perform predetermined functions described in the specification. For example, the controller 7 generates the sound signal and outputs the sound signal to the power amplifier 6. The controller 7 can start and stop generating the notification sound.

The sound generator 1 is provided with a brake sensor 8 (denoted as "BRK" in the drawings) for detecting a condition of a brake of the vehicle. A brake signal indicative of the detected brake condition is outputted from the brake sensor 8 and inputted to the controller 7. The sound generator 1 is provided with a speed sensor 9 (denoted as "VM" in the drawings) for detecting a running speed of the vehicle. A speed signal indicative of the detected running speed is outputted from the speed sensor 9 and inputted to the controller 7. The controller 7 generates the notification sound based on the speed signal. Specially, the controller 7 generates the notification sound when the speed of the vehicle is in a predetermined range. For example, the controller 7 can generate the notification sound when the speed of the vehicle falls within a low speed range from 0 km/h to 20 km/h. The sound generator 1 is provided with a selector 10 (denoted as "ON/OFF" in the drawings) for outputting a selection signal for allowing or preventing the generation of the sound signal. The selection signal is inputted from the selector 10 to the controller 7. For example, the selector 10 can be a switch operable by a driver of the vehicle or another electronic control unit mounted on the vehicle. For example, the selector 10 can prevent the generation of the sound signal when the vehicle is parked, and can allow the generation of the sound signal when the vehicle is in the operating state. The driver can stop the generation of the notification sound at any time by operating the selector 10 so that the generation of the sound signal can be prevented.

The sound generator 1 is provided with a warning device 11 (denoted as "WRN" in the drawings) which is activated upon detection of a failure in the speaker 2. The warning device 11 aurally or visually informs a user of the vehicle that a failure occurs in the speaker 2. For example, the warning device 11 can be a warning lamp, a warning buzzer, or a display device that displays a warning image on a display screen mounted on the vehicle.

The controller 7 includes a sound signal generator 15 (denoted as "SDG" in the drawings) for generating the sound signal according to the speed of the vehicle. Specifically, the sound signal generator 15 generates the sound signal by synthesizing sound data stored in a memory device that is located inside or outside the controller 7. The sound signal generated by the sound signal generator 15 is inputted to the power amplifier 6. The controller 7 includes a control section 16 (denoted as "CNT" in the drawings) for controlling the sound signal generator 15. The control section 16 controls the sound signal generator 15 in accordance with the brake signal from the brake sensor 8, the speed signal from the speed sensor 9, and the selection signal from the selector 10. The control section 16 allows the controller 7 to start and stop generating the notification sound.

The sound generator 1 includes the failure detection device 100 for detecting a failure in the speaker 2. Specifically, the failure detection device 100 detects an open-circuit and/or a short-circuit in the speaker 2. The open-circuit in the speaker 2 can include a break in a wire of an internal circuit of the speaker 2 and a break in a wire of an energization circuit for energizing the speaker 2. Thus, the failure detection device 100 detects the open-circuit in the speaker 2 including the speaker circuit. The short-circuit in the speaker 2 can include a short-circuit in the wire of the internal circuit of the speaker 2, a short-circuit of the terminal of the speaker 2 to the ground potential, and a short-circuit of the energization circuit for energizing the speaker 2 to the ground potential. Thus, the failure detection device 100 detects the short-circuit in the speaker 2 including the speaker circuit. The failure detection device 100 operates to detect the open-circuit and/or the short-circuit in the speaker 2 during a time period where the activation voltage +B is supplied. That is, the failure detection device 100 can operate to detect the failure in the speaker 2, even when the vehicle is in the activation state where the vehicle can run. For example, the failure detection device 100 can operate to detect the failure in the speaker 2 immediately after a user of the vehicle turns ON the power switch 4 to drive the vehicle.

The failure detection device 100 includes a test current supply circuit 12. The supply circuit 12 supplies a DC test current to the speaker 2 in order to test whether the speaker 2 operates normally or abnormally. The test current supplied by the supply circuit 12 is so small that an influence of the test current on a tone of the notification sound outputted from the speaker 2 can be reduced. An amplitude of the test current supplied to the speaker 2 from the supply circuit 12 is much smaller than an amplitude of the AC current supplied to the speaker 2 to cause the speaker 2 to output the notification sound. For example, the amplitude of the test current which is supplied from the supply circuit 12 to the speaker 2 can be one-hundredth of the amplitude of the AC current which is supplied through the coupling capacitor 5 to the speaker 2.

The supply circuit 12 generates the test current from the activation voltage B. The supply circuit 12 applies a test voltage to the speaker 2 to test the speaker 2. The test voltage is greater than the voltage of the sound signal which is applied through the coupling capacitor 5 to the speaker 2 from the power amplifier 6. By applying the test voltage to the speaker 2, the supply circuit 12 supplies the test current to the speaker 2 in such a manner that the test current does not flow through the coupling capacitor 5. The activation voltage +B can vary depending on the power source 3. That is, the supply circuit 12 generates the test current from the activation voltage +B that can vary. Accordingly, a voltage drop caused by the test current can vary depending on the activation voltage +B. The supply circuit 12 does not supply the test current when the vehicle is not in the activation state. Thus, when the vehicle is not driven, unnecessary power consumption for the test of the speaker 2 can be prevented.

The supply circuit 12 supplies the test current to the speaker 2 from a node between the coupling capacitor 5 and the speaker 2. Thus, the supply circuit 12 can supply the test current to the speaker 2 without through the coupling capacitor 5.

The supply circuit 12 includes resistors 21 and 22 that form a voltage divider for dividing the activation voltage +B. The supply circuit 12 further includes a diode 23. An anode of the diode 23 is connected to the voltage divider, and a cathode of the diode 23 is connected to the positive terminal of the speaker 2. The diode 23 is connected in a forward bias direction so that the activation voltage +B can be supplied toward the speaker 2. The resistor 21 and the diode 23 of the supply circuit 12 also form a pull-up circuit for applying a DC voltage to the positive terminal of the speaker 2. The resistor 22 is used to produce a voltage according to a change in impedance of the speaker 2.

A voltage Va appears at an node between the cathode of the diode 23 and the coupling capacitor 5. That is, the voltage Va appears at the positive terminal of the speaker 2. The voltage Va is a combined voltage of the AC voltage for the notification sound generation and the test voltage.

The sound generator 1 includes a detection circuit 13 for detecting a voltage signal which changes with the impedance of the speaker 2. The detection circuit 13 directly or indirectly detects a voltage appearing at the terminal of the speaker 2 coupled to the coupling capacitor 5. According to the first embodiment, the detection circuit 13 indirectly detects the voltage appearing at the terminal of the speaker 2 based on a voltage drop across the resistor 22.

The detection circuit 13 also serves as a converter for converting the voltage varying depending on the activation voltage +B into a voltage acceptable by the controller 7. Specifically, the detection circuit 13 detects the voltage drop across the resistor 22 and outputs a voltage Vb. The voltage Vb is measured to detect the open-circuit and/or the short-circuit in the speaker 2.

The detection circuit 13 also serves as a protector for protecting the controller 7 from a circuit to which the activation voltage +B is directly applied. The detection circuit 13 includes a diode 31. An anode of the diode 31 is connected to the ground potential, and a cathode of the diode 31 is connected to an output terminal of the detection circuit 13. That is, the diode 31 is connected in a reverse bias direction between the ground potential and the output terminal of the detection circuit 13. Thus, the diode 31 can serve as a protection diode for blocking a negative voltage. When the sound signal is supplied to the speaker 2, the voltage Va changes in positive and negative directions. The diode 31 removes the negative voltage to prevent the negative voltage from being inputted to the controller 7. Thus, an input port of the controller 7 can be protected.

The detection circuit 13 further includes a diode 32. An anode of the diode 32 is connected to the output terminal of the detection circuit 13, and a cathode of the diode 32 is connected to a power source Vc. That is, the diode 32 is connected in a reverse bias direction between the output terminal of the detection circuit 13 and the power source Vc. The power source Vc provides a stabilized power supply voltage for an electronic circuit. The power source Vc and the diode 32 form a pull-up circuit for limiting the detected voltage to the power supply voltage of the power source Vc. Thus, even when the activation voltage +B is used as a power supply for the supply circuit 12, the detected voltage can be limited to a voltage for an electronic circuit and inputted to the controller 7.

The detection circuit 13 includes a resistor 33 that serves as a current limiter. A first end of the resistor 33 is connected between the resistors 21 and 22. A second end of the resistor 33 is connected between the diodes 31 and 32. The diodes 31 and 32 are connected in series. The resistor 33 and the series circuit of the diodes 31 and 32 construct a protection circuit for limiting the detected voltage.

Further, the detection circuit 13 includes a filter circuit 34 (denoted as "FLT" in the drawings) including a low-pass filter that passes low frequency components but blocks high frequency components. The filter circuit 34 can include a capacitor 35. The output of the detection circuit 13 is inputted to the controller 7.

The controller 7 provides a determination section 14. The controller 7 has the input port for receiving the voltage Vb detected by the detection circuit 13. The input port of the controller 7 is an AD conversion port. The controller 7 includes an analog-to-digital (A/D) converter 41 (denoted as "A/D" in the drawings) for converting the voltage Vb into digital data. According to the first embodiment, the determination section 14 is implemented by software. i.e., the programs performed by the controller 7. The determination section 14 compares the voltage Vb detected by the detection circuit 13 with a first threshold voltage VH and a second threshold voltage VL. In such a configuration, when the open-circuit occurs in the speaker 2 under a condition where the voltage of the sound signal is applied to the speaker 2 so that sound can be outputted from the speaker 2, the test voltage higher than the voltage of the sound signal appears at the terminal of the speaker 2. That is, the voltage appearing at the terminal of the speaker 2 is different between when the speaker 2 operates normally and when the speaker 2 operates abnormally. Therefore, the determination section 14 can determine whether the open-circuit occurs in the speaker 2 based on the voltage Vb during a period of time when the voltage of the sound signal is applied to the speaker 2. For this reason, the test voltage applied by the supply circuit 12 to the speaker 2 is set to a value greater than a variation range within which the voltage of the sound signal can vary.

Specifically, the determination section 14 includes an open-circuit detector 42 (denoted as "OCD" in the drawings) for detecting the open-circuit in the speaker 2. The open-circuit detector 42 determines whether the open-circuit occurs in the speaker 2 by comparing the voltage Vb, indicated by an output of the A/D converter 41, with the first threshold voltage VH. The first threshold voltage VH is set so that the open-circuit detector 42 can determine whether the voltage Vb is almost equal to the power supply voltage of the power source Vc. When the voltage Vb increases above the first threshold voltage VH, the open-circuit detector 42 determines that the open-circuit occurs in the speaker 2. When the open-circuit detector 42 determines that the open-circuit occurs in the speaker 2, the open-circuit detector 42 outputs a first activation signal for activating the warning device 11. In response to the first activation signal, the warning device 11 is activated and outputs a first alarm indicating that the open-circuit occurs in the speaker 2.

The determination section 14 further includes a short-circuit detector 43 (denoted as "SCD" in the drawings) for detecting the short-circuit in the speaker 2. The short-circuit detector 43 determines whether the short-circuit occurs in the speaker 2 by comparing the voltage Vb, indicated by the output of the A/D converter 41, with the second threshold voltage VL. It is noted that the second threshold voltage VL is lower than the first threshold voltage VH. The second threshold voltage VL is set so that the short-circuit detector 43 can determine whether the voltage Vb is almost equal to zero volts (0V). When the voltage Vb decreases below the second threshold voltage VL, the short-circuit detector 43 determines that the short-circuit occurs in the speaker 2. When the short-circuit detector 43 determines that the short-circuit occurs in the speaker 2, the short-circuit detector 43 outputs a second activation signal for activating the warning device 11. In response to the second activation signal, the warning device 11 is activated and outputs a second alarm indicating that the short-circuit occurs in the speaker 2.

As mentioned previously, the supply circuit 12 generates the test current from the activation voltage +B which can vary. The controller 7 includes a monitor section 46 (denoted as "MO" in the drawings) for detecting a reduction in the activation voltage +B, which is a power supply for the supply circuit 12. The monitor section 46 has a masking part for masking a determination signal outputted from the determination section 14 when the activation voltage +B is reduced below a predetermined lower limit value. The monitor section 46 supplies a masking signal, for masking the determination signal, to the open-circuit detector 42. Thus, inaccurate determination caused by the reduction in the activation voltage +B can be prevented.

A normal resistance of the speaker 2 is a few ohms, for example eight ohms (8Ω). A resistance of the resistor 21 serving as a pull-up resistor is set to a value much greater than the resistance of the speaker 2. For example, the resistance of the resistor 21 can be ten kilo-ohms (10 kΩ). A resistance of the resistor 22 is set so that the voltage divider constructed with the resistors 21 and 22 can have a predetermined voltage division ratio. The resistance of the resistor 22 can be set so that the voltage Vb can decrease below the first threshold voltage VH when the activation voltage +B is reduced below the lower limit value. In this case, even if the open-circuit actually occurs in the speaker 2, the voltage Vb does not exceed the first threshold voltage VH. In other words, when the activation voltage +B is reduced below the lower limit value, the determination whether the open-circuit occurs in the speaker 2 is fixed to a non-detection condition so that the inaccurate determination caused by the reduction in the activation voltage +B can be prevented. The lower limit value for the activation voltage +B is set to a value low enough to prevent the failure detection device 100 from operating normally. For example, the lower limit value can be set to 8V. In this case, when the activation voltage +B is reduced below 8V, the voltage Vb does not reach the power supply voltage of the power source Vc. In this way, the masking part of the monitor section 46 prevents the inaccurate determination caused by the reduction in the activation voltage +B below the lower limit value. For example, the resistance of the resistor 22 can be 20 kΩ.

For example, a resistance of the resistor 33 is set to a value suitable to limit the current. For example, the resistance of the resistor 33 can be 10 kΩ. The power supply voltage of the power source Vc can be 5V, for example.

FIGS. 2A, 2B, 2C, 2D, 2E, and 2F are diagrams illustrating waveforms of voltages of portions of the sound generator 1. It is noted that the waveforms shown in these drawings are observed by using an oscilloscope and simplified for the purpose of explanation.

Figure 2A:
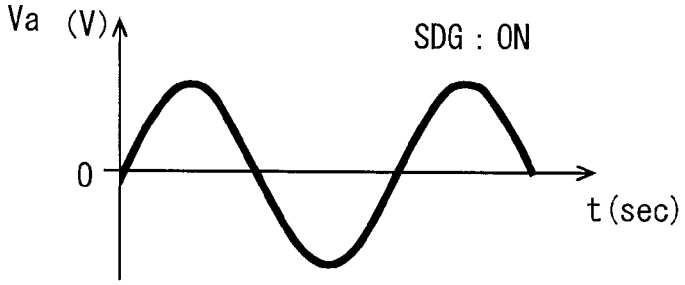
FIG. 2A is a diagram illustrating a waveform of a voltage of a first portion of the sound generator of FIG. 1 observed when a notification sound is generated.
Figure 2B:
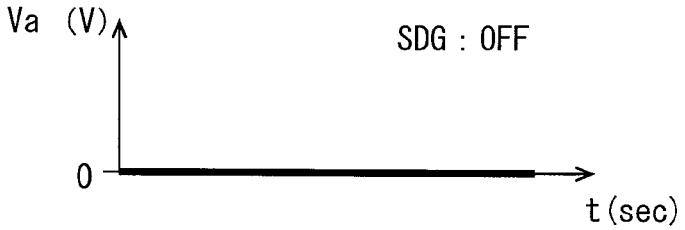
FIG. 2B is a diagram illustrating the waveform of the voltage of the first portion observed when the notification sound is not generated.

FIG. 2A illustrates the waveform of the voltage Va observed when the notification sound is generated. During operation of the sound signal generator 15, i.e., during an ON-period of the sound signal generator 15, an AC signal used to generate the notification sound appears as the voltage Va. FIG. 2B illustrates the waveform of the voltage Va observed when the notification sound is not generated. During non-operation of the sound signal generator 15, i.e., during an OFF-period of the sound signal generator 15, the DC test voltage appears as the voltage Va. As mentioned previously, when the speaker 2 operates normally, the speaker 2 has a predetermined low resistance (e.g., 8Ω). Since the resistance (e.g., 20 kΩ) of the resistor 22 is much greater than the normal resistance of the speaker 2, the voltage Va is almost 0V.

Figure 2C:
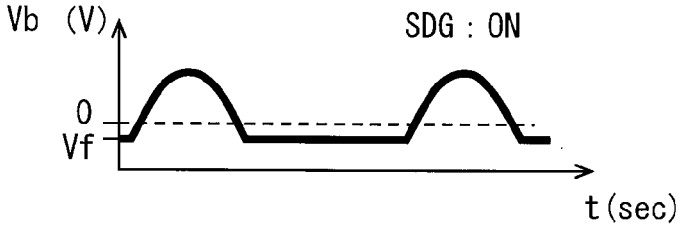
FIG. 2C is a diagram illustrating a waveform of a voltage of a second portion of the sound generator of FIG. 1 observed when a notification sound is generated.
Figure 2D:
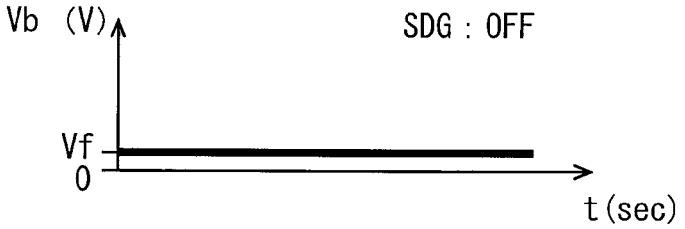
FIG. 2D is a diagram illustrating the waveform of the voltage of the second portion observed when the notification sound is not generated.

FIG. 2C illustrates the waveform of the voltage Vb observed when the notification sound is generated. During the operation of the sound signal generator 15, a half-wave rectified voltage generated by the diode 31 appears as the voltage Vb. The voltage waveform shown in FIG. 2C corresponds to the voltage of the sound signal. In this case, the voltage Vb does not reach the power supply voltage of the power source Vc. That is, the maximum value of the voltage Vb is smaller than the power supply voltage of the power source Vc. FIG. 2D illustrates the waveform of the voltage Vb observed when the notification sound is not generated. During the non-operation of the sound signal generator 15, the voltage Vb is almost 0V. It is noted that a symbol "Vf" in FIGS. 2C and 2D represents a forward voltage drop of the diode 31.

Figure 2E:
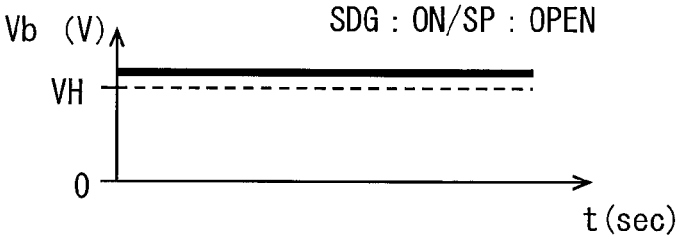
FIG. 2E is a diagram illustrating the waveform of the voltage of the second portion observed when an open-circuit occurs in a speaker under a condition where the notification sound is generated.

FIG. 2E illustrates the waveform of the voltage Vb observed when the open-circuit occurs in the speaker 2 under a condition where the notification sound is generated. When the open-circuit occurs in the speaker 2 (e.g., in the voice coil), the resistance of the speaker 2 increases to near infinity. When the open-circuit occurs in the speaker 2 under a condition where the test current is supplied to the speaker 2, the voltage drop across the resistor 22 increases to a value calculated by dividing the activation voltage +B by the voltage division ratio of the voltage divider constructed with the resistors 21 and 22. The voltage drop across the resistor 22 forward-biases the diode 32. As a result, the voltage Vb becomes almost equal to the power supply voltage of the power source Vc. Since the first threshold voltage VH is slightly smaller than the power supply voltage of the power source Vc, the open-circuit detector 42 detects the open-circuit in the speaker 2.

Figure 2F:
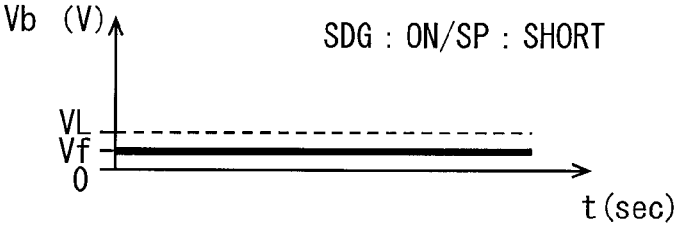
FIG. 2F is a diagram illustrating the waveform of the voltage of the second portion observed when a short-circuit occurs in the speaker under the condition where the notification sound is generated.

FIG. 2F illustrates the waveform of the voltage Vb observed when the short-circuit occurs in the speaker 2 under a condition where the notification sound is generated. When the short-circuit occurs in the speaker 2 (e.g., in the voice coil), the resistance of the speaker 2 decreases to near 0Ω. When the short-circuit occurs in the speaker 2 under a condition where the test current is supplied to the speaker 2, the voltage drop across the resistor 22 decreases to the forward voltage drop Vf. As a result, the voltage Vb becomes equal to the forward voltage drop Vf. Since the second threshold voltage VL is slightly higher than the forward voltage drop Vf, the short-circuit detector 43 detects the short-circuit in the speaker 2. The second threshold voltage VL is set so that the voltage Vb, shown in FIG. 2C, observed when the speaker 2 operates normally can be distinguished from the voltage Vb, shown in FIG. 2F, observed when the short-circuit occurs in the speaker 2.

Figure 3:
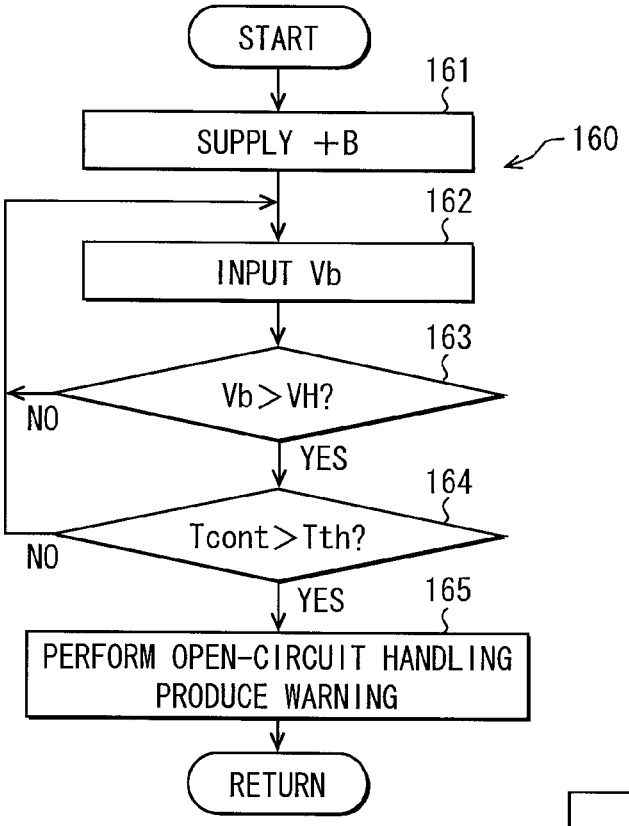
FIG. 3 is a flow chart of an open-circuit determination process performed in the sound generator of FIG. 1.

FIG. 3 is a flow chart of an open-circuit determination process 160 for implementing the open-circuit detector 42. The open-circuit determination process 160 starts at step 160, where it is made sure that the activation voltage +B is supplied. That is, at step 160, it is made sure that the supply circuit 12 operates on the activation voltage +B so that the test current can be supplied to the speaker 2.

Then, the open-circuit determination process 160 proceeds to step 162, where the voltage Vb to be measured is inputted to the controller 7. Further, at step 162, the voltage Vb is converted by the A/D converter 41 into digital data. Then, the open-circuit determination process 160 proceeds to step 163, where the voltage Vb is compared with the first threshold voltage VH. Specifically, at step 163, it is determined whether the voltage Vb is greater than the first threshold voltage VH. If the voltage Vb is not greater than the first threshold voltage VH corresponding to NO at step 163, the open-circuit determination process 160 returns to step 162. In contrast, if the voltage Vb is greater than the first threshold voltage VH corresponding to YES at step 163, the open-circuit determination process 160 proceeds to step 164.

At step 164, it is determined whether a period Tcont, during which the voltage Vb remains greater than the first threshold voltage VH, exceeds a predetermined threshold period Tth. Step 164 stabilizes a subsequent open-circuit determination process by ignoring a temporary open-circuit condition. For example, the period Tcont can be five hundred microseconds (500 ms). If the period Tcont does not exceed the threshold period Tth corresponding to NO at step 164, the open-circuit determination process 160 returns to step 162. In contrast, if the period Tcont exceeds the threshold period Tth corresponding to YES at step 164, the open-circuit determination process 160 proceeds to step 165.

In this way, the determination section 14 compares the voltage Vb detected by the detection circuit 13 with the first threshold voltage VH and determines that the open-circuit occurs in the speaker 2 when the detected voltage Vb achieves a predetermined relationship (i.e., Vb>VH) with respect to the first threshold voltage VH. Specifically, the determination section 14 determines that the open-circuit occurs in the speaker 2, when the predetermined relationship continues for the threshold period Tth.

At step 165, a predetermined open-circuit handling procedure is performed in response to the detection of the open-circuit in the speaker 2. According to the first embodiment, the open-circuit handling procedure includes a warning procedure for informing a user of the vehicle that the open-circuit occurs in the speaker 2. Specifically, at step 165, the warning device 11 is activated. In addition to or instead of the warning procedure, the open-circuit handling procedure can include a protection procedure for stopping the sound signal generator 15.

Figure 4:
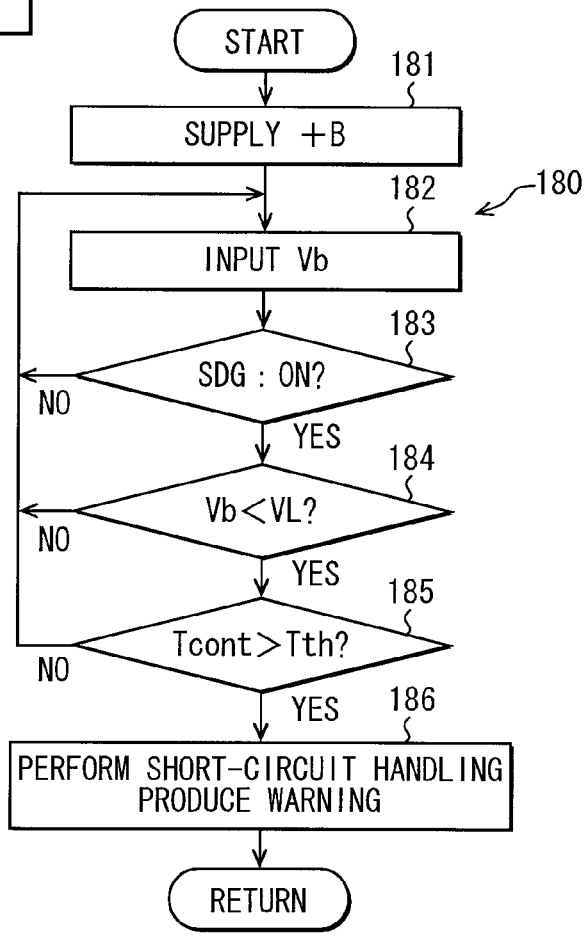
FIG. 4 is a flow chart of a short-circuit determination process performed in the sound generator of FIG. 1.

FIG. 4 is a flow chart of a short-circuit determination process 180 for implementing the short-circuit detector 43. The short-circuit determination process 180 starts at step 181, where it is made sure that the activation voltage +B is supplied. That is, at step 181, it is made sure that the supply circuit 12 operates on the activation voltage +B so that the test current can be supplied to the speaker 2.

Then, the short-circuit determination process 180 proceeds to step 182, where the voltage Vb to be measured is inputted to the controller 7. Further, at step 182, the voltage Vb is converted by the A/D converter 41 into digital data. Then, the short-circuit determination process 180 proceeds to step 183, where it is determined whether the sound signal generator 15 is operating (i.e., ON). According to the first embodiment, only when the sound signal generator 15 is ON, it can be determined whether the speaker 2 operates normally or the short-circuit occurs in the speaker 2. That is, it is impossible to distinguish the waveform of the voltage Vb shown in FIG. 2F from the waveform of the voltage Vb shown in FIG. 2D. However, it is possible to distinguish the waveform of the voltage Vb shown in FIG. 2F from the waveform of the voltage Vb shown in FIG. 2C. Therefore, the most part of the short-circuit determination process 180 is performed only when the sound signal generator 15 is ON. If the sound signal generator 15 is stopped (i.e., OFF) corresponding to NO at step 183, the short-circuit determination process 180 returns to step 182. In contrast, if the sound signal generator 15 is ON corresponding to YES at step 183, the short-circuit determination process 180 proceeds to step 184.

At step 184, the voltage Vb is compared with the second threshold voltage VL. Specifically, at step 184, it is determined whether the voltage Vb is less than the second threshold voltage VL. Alternatively, at step 184, it can be determined whether the voltage Vb is almost 0V. If the voltage Vb is not less than the second threshold voltage VL corresponding to NO at step 184, the short-circuit determination process 180 returns to step 182. In contrast, if the voltage Vb is less than the second threshold voltage VL corresponding to YES at step 184, the short-circuit determination process 180 proceeds to step 185.

At step 185, it is determined whether a period Tcont, during which the voltage Vb remains less than the second threshold voltage VL, exceeds a predetermined threshold period Tth. Step 185 stabilizes a subsequent short-circuit determination process by ignoring a temporary short-circuit condition. If the period Tcont does not exceed the threshold period Tth corresponding to NO at step 185, the short-circuit determination process 180 returns to step 182. In contrast, if the period Tcont exceeds the threshold period Tth corresponding to YES at step 185, the short-circuit determination process 180 proceeds to step 186.

In this way, the determination section 14 compares the voltage Vb detected by the detection circuit 13 with the second threshold voltage VL and determines that the short-circuit occurs in the speaker 2 when the detected voltage Vb achieves a predetermined relationship (i.e., Vb<VH) with respect to the second threshold voltage VL. Specifically, the determination section 14 determines that the short-circuit occurs in the speaker 2, when the predetermined relationship continues for the threshold period Tth.

At step 186, a predetermined short-circuit handling procedure is performed in response to the detection of the short-circuit in the speaker 2. According to the first embodiment, the short-circuit handling procedure includes a warning procedure for informing a user of the vehicle that the short-circuit occurs in the speaker 2. Specifically, at step 186, the warning device 11 is activated. In addition to or instead of the warning procedure, the short-circuit handling procedure can include a protection procedure for stopping the sound signal generator 15.

The open-circuit determination process 160 and the short-circuit determination process 180 are repeatedly performed immediately after the vehicle is powered ON (e.g., by turning a key to accessory position), so that the activation voltage +B can be supplied, until the vehicle is powered OFF. Thus, whether or not the open-circuit and the short-circuit occur in the speaker 2 can be determined immediately after there arises a possibility to generate the notification sound. Since the vehicle is powered ON before being ready to run, whether or not the open-circuit and the short-circuit occur in the speaker 2 can be determined before there arises a need to generate the notification signal. Further, in addition to before generation of the notification sound, whether or not the open-circuit and the short-circuit occur in the speaker 2 can be determined during the generation of the notification sound.

Second Embodiment

Figure 5:
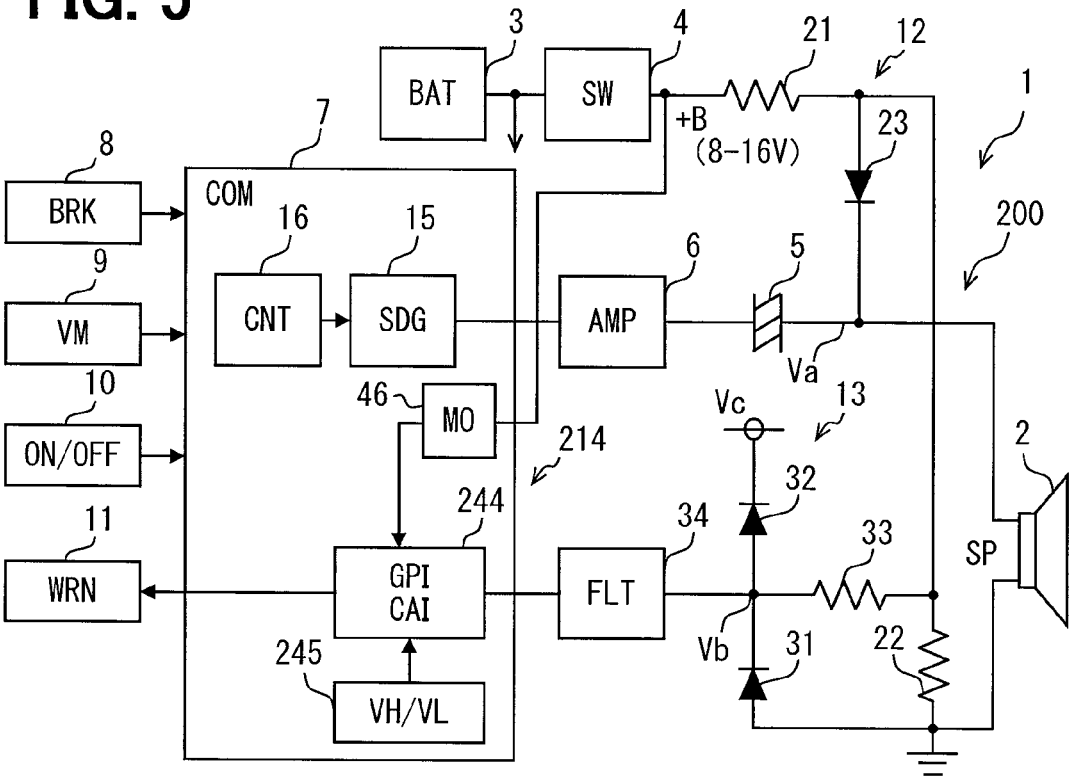
FIG. 5 is a block diagram of an operation notification sound generator including a failure detection device according to a second embodiment of the present disclosure.

FIG. 5 is a block diagram of an operation notification sound generator 1 including a failure detection device 200 according to a second embodiment of the present disclosure. A difference of the second embodiment from the first embodiment is as follows.

In the first embodiment, the voltage Vb is compared with the threshold voltages VH and VL by software programs performed by the controller 7.

In the second embodiment, the voltage Vb is compared with the threshold voltages VH and VL by hardware. Specifically, an input port 244 of the controller 7 has an input voltage determining function of comparing the voltage Vb with the threshold voltages VH and VL.

The failure detection device 200 has a determination section 214. The determination section 214 has the input port 244. The input port 244 is a general purpose input port (GPI) or an input capture port (CAI) of the controller 7. Further, the determination section 214 has a threshold setting portion 245 for setting the threshold voltages VH and VL. The threshold setting portion 245 is provided by a circuit of the determination section 214. The input port 244 determines that an input voltage to the input port 244 is high when the input voltage is higher than the first threshold voltage VH. The input port 244 determines that the input voltage is low when the input voltage is lower than the second threshold voltage VL. Further, the input port 244 has a filtering function of determining that the input voltage is at the level (i.e., low or high) as long as a period during which the input voltage is kept at the level exceeds a predetermined time.

According to the second embodiment, the determination section 14 compares the voltage Vb detected by the detection circuit 13 with the threshold voltages VH and VL by using the input voltage determining function which the input port 244 of the controller 7 has. Thus, the determination section 14 can determine whether the voltage Vb increases above the first threshold voltage VH, i.e., determine whether the open-circuit occurs in the speaker 2. For example, the first threshold voltage VH can be about 4.2V, which is a voltage level observed in a typical microcomputer. That is, the first threshold voltage VH can be almost equal to the power supply voltage of the power source Vc. In such an approach, the voltage Vb observed when the open-circuit occurs in the speaker 2 during the generation of the notification sound can be suitably distinguished based on the first threshold voltage VH from the voltage Vb observed when the speaker 2 operates normally during the generation of the notification sound. Thus, incorrect determination can be reduced by a simple configuration.

Likewise, the determination section 14 can determine whether the voltage Vb decreases below the second threshold voltage VL, i.e., determine whether the short-circuit occurs in the speaker 2. In this case, step 183 of the short-circuit determination process 180 is performed by the controller 7.

Third Embodiment

Figure 6:
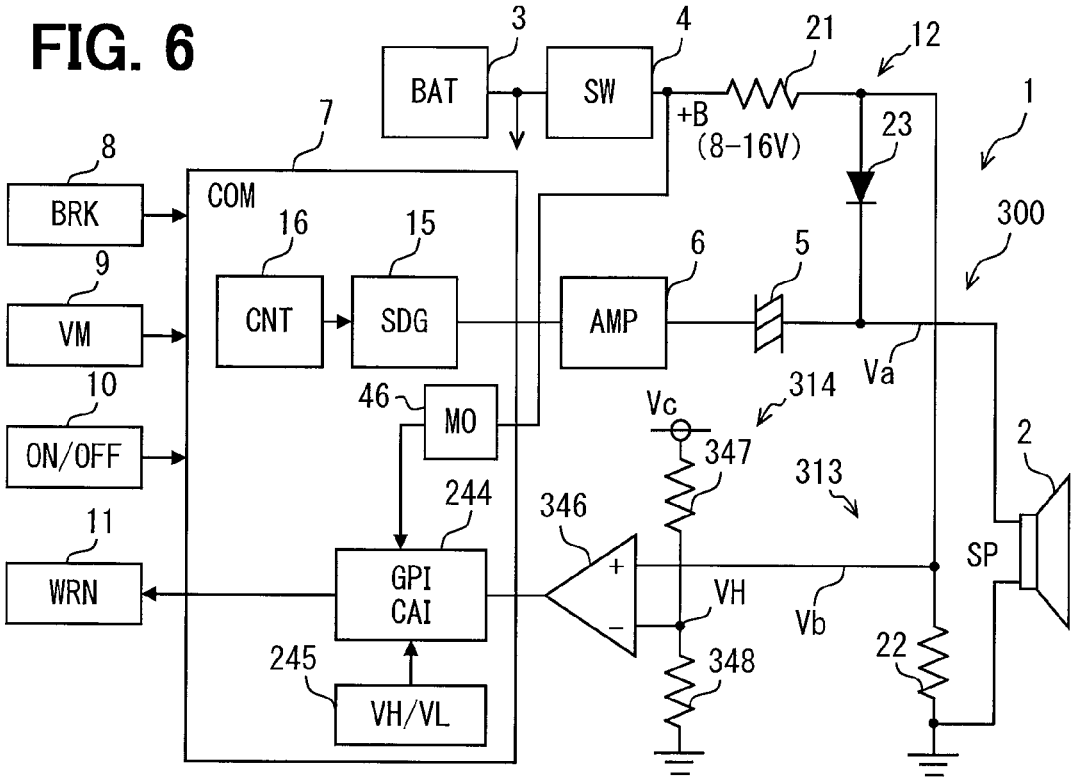
FIG. 6 is a block diagram of an operation notification sound generator including a failure detection device according to a third embodiment of the present disclosure.

FIG. 6 is a block diagram of an operation notification sound generator 1 including a failure detection device 300 according to a third embodiment of the present disclosure. A difference of the third embodiment from the preceding embodiments is as follows.

In the preceding embodiments, the voltage Vb is compared with the threshold voltages VH and VL by software programs performed by the controller 7 or by the input port 244 of the controller 7.

In the third embodiment, the voltage Vb is compared with the threshold voltages VH and VL by a hardware structure separate from the controller 7.

The failure detection device 300 includes a detection circuit 313. The detection circuit 313 detects the voltage drop across the resistor 22. The failure detection device 300 includes a determination section 314. The determination section 314 has a comparison circuit constructed with a comparator 346. The comparison circuit compares the voltage Vb detected by the detection circuit 313 with the threshold voltages VH and VL. The comparison circuit includes resistors 347 and 348 in addition to the comparator 346. The resistors 347 and 348 form a setting circuit for setting the first threshold voltage VH. A series circuit of the resistors 347 and 348 is connected in series with the power source Vc and serves as a voltage divider for dividing the power supply voltage of the power source Vc by a predetermined voltage division ratio. A non-inverting input terminal of the comparator 346 is connected to the detection circuit 313. An inverting input terminal of the comparator 346 is connected to the voltage divider. An output terminal of the comparator 346 is connected to the input port 244. When the voltage Vb increases above the first threshold voltage VH, the comparison circuit determines that the open-circuit occurs in the speaker 2. When the comparison circuit determines that the open-circuit occurs in the speaker 2, the controller 7 activates the warning device 11.

Likewise, the comparison circuit can determine whether the voltage Vb decreases below the second threshold voltage VL, i.e., determine whether the short-circuit occurs in the speaker 2. In this case, step 183 of the short-circuit determination process 180 is performed by the controller 7.

As described above, according to the third embodiment, the input voltage to the controller 7 is adjusted by the comparator 346. In such an approach, a circuit configuration of the detection circuit 313 can be simplified. Further, the GPI port or the CAI port of the controller 7 can be used. Furthermore, whether or not the open-circuit occurs in the speaker 2 can be determined without an increase in the processing load on the controller 7.

Fourth Embodiment

Figure 7:
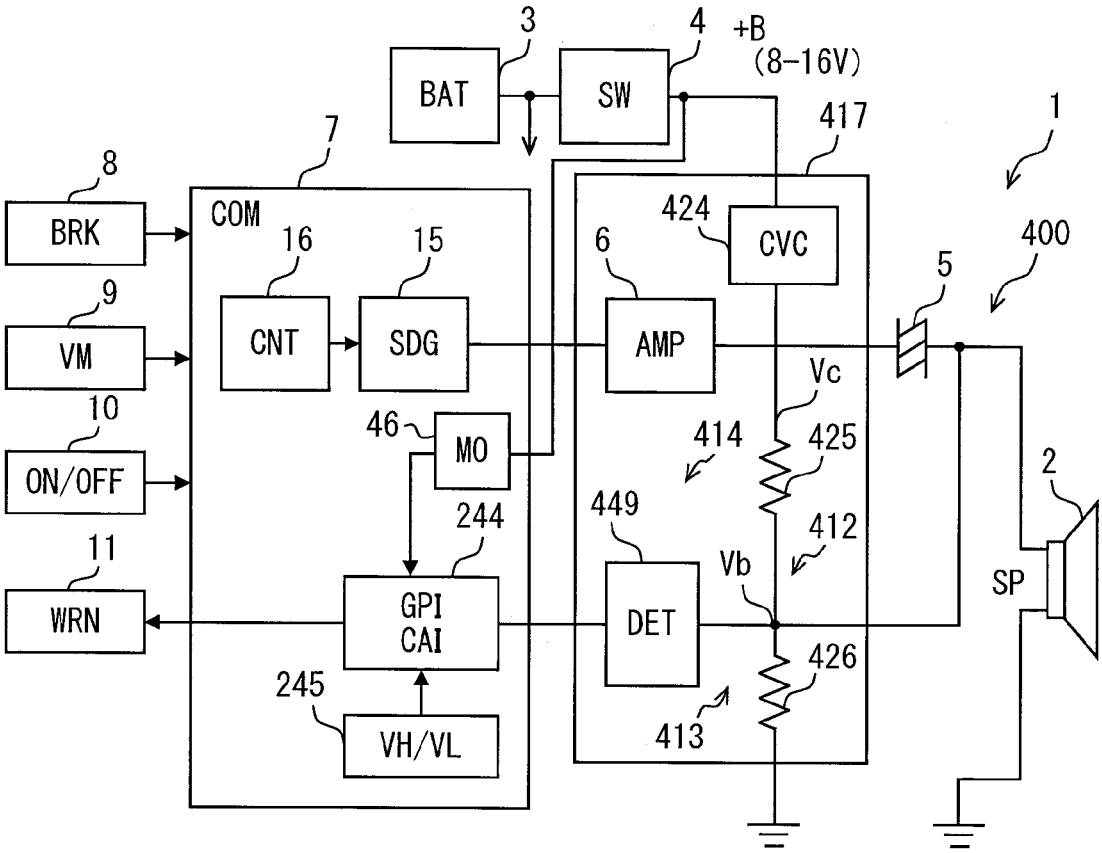
FIG. 7 is a block diagram of an operation notification sound generator including a failure detection device according to a fourth embodiment of the present disclosure.

FIG. 7 is a block diagram of an operation notification sound generator 1 including a failure detection device 400 according to a fourth embodiment of the present disclosure. In the fourth embodiment, a circuit for driving the speaker 2 and a circuit for detecting a failure in the speaker 2 are configured as an integrated circuit.

The failure detection device 400 includes an integrated circuit 417. The integrated circuit 417 is located between the controller 7 and the speaker 2. The power amplifier 6 is incorporated in the integrated circuit 417. The coupling capacitor 5 is located outside the integrated circuit 417. The integrated circuit 417 includes a constant-voltage circuit (CVC) 424. The constant-voltage circuit 424 receives power from the activation voltage +B and supplies power to an internal circuit of the integrated circuit 417. In particular, the constant-voltage circuit 424 supplies a constant voltage Vc to a supply circuit 412. The supply circuit 412 includes, resistors 425 and 426 that form a voltage divider for dividing the constant voltage Vc by a predetermined voltage division ratio. A connection point between the resistors 425 and 426 is connected between the coupling capacitor 5 and the speaker 2. Thus, a very small test current is supplied from the constant-voltage circuit 424 to the speaker 2 through the supply circuit 412.

The failure detection device 400 includes a detection circuit 413. The detection circuit 413 detects the voltage Vb appearing across the resistor 426. The failure detection device 400 includes a determination section 414. The determination section 414 has a determination circuit (denoted as "DET" in the drawings) 449. The determination circuit 449 determines whether the open-circuit and/or the short-circuit occurs in the speaker 2 based on the voltage Vb.

The determination circuit 449 includes a first comparator for detecting whether the voltage Vb increases above the first threshold voltage VH. Further, the determination circuit 449 includes a first continuation determination portion for determining whether a first continuous period, during which the voltage Vb remains greater than the first threshold voltage VH, exceeds a first threshold period. When the first continuous period exceeds the first threshold period, the determination circuit 449 determines that the open-circuit occurs in the speaker 2.

Further, the determination circuit 449 can include a second comparator for detecting whether the voltage Vb decreases below the second threshold voltage VL during a period of time the sound signal generator 15 generates the sound signal. Further, the determination circuit 449 includes a second continuation determination portion for determining whether a second continuous period, during which the voltage Vb remains less than the second threshold voltage VL, exceeds a second threshold period. When the second continuous period exceeds the second threshold period, the determination circuit 449 determines that the short-circuit occurs in the speaker 2.

An output of the determination circuit 449 is inputted to the controller 7. When it is determined that the open-circuit and/or the short-circuit occurs in the speaker 2, the controller 7 activates the warning device 11.

As described above, according to the fourth embodiment, the supply circuit 412, the detection circuit 413, and the determination circuit 414 are incorporated in the integrated circuit 417. In such an approach, most of components of the failure detection device 400 can be incorporated in the integrated circuit 417.

Modifications

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

In the embodiments, the sections provided by the controller 7 are implemented by software. Alternatively, the sections provided by the controller 7 can be implemented by hardware or a combination of software and hardware. For example, the controller 7 can be implemented by an analog circuit.

In the embodiments, it is determined whether each of the open-circuit and the short-circuit occurs in the speaker 2. Alternatively, it can be determined whether only one of the open-circuit and the short-circuit occurs in the speaker 2.

In the embodiments, the activation voltage +B is supplied when the power switch 4 of the vehicle is in the ON position. Alternatively, the activation voltage +B can be supplied when high voltage power supply which an electric vehicle uses to run is available. For example, the activation voltage +B can be supplied only when a high voltage battery for supplying power to a motor of an electric vehicle is ready to supply the power.

In the embodiments, the signal transmission from the determination sections 314, 414 to the controller 7 is accomplished by using a low level signal or a high level signal. Alternatively, the signal transmission from the determination sections 314, 414 to the controller 7 can be accomplished by a communication circuit for establishing communication between the determination sections 314, 414 and the controller 7 or by a transmission circuit using a pulse signal. For example, an in-vehicle network can be used to accomplish the signal transmission from the determination sections 314, 414 to the controller 7.

In the embodiments, the controller 7 outputs the activation signal directly to the warning device 11. That is, the controller 7 directly performs a failure handing such as the open-circuit handling or the short-circuit handling. Alternatively, the controller 7 can output a handling signal to another device, and the other device can perform the failure handing.

What is claimed is:

1. A failure detection device for a speaker mounted on a vehicle, the failure detection device comprising:

a signal generator configured to generate a sound signal corresponding to a sound outputted from the speaker;

an amplifier configured to amplify the sound signal generated by the signal generator;

a coupling capacitor configured to supply the sound signal amplified by the amplifier to the speaker;

a supply circuit configured to supply a direct-current test current to the speaker in such a manner that the test current does not flow through the coupling capacitor by applying a test voltage to the speaker, the test voltage being higher than a voltage of the sound signal supplied from the coupling capacitor to the speaker;

a detection circuit configured to directly or indirectly detect a terminal voltage on a terminal of the speaker; and a determination section configured to determine whether at least one of an open-circuit and a short-circuit occurs in the speaker based on the terminal voltage during application of the voltage of the sound signal to the speaker; wherein:

an amplitude of the test current is smaller than an amplitude of the sound signal supplied through the cooling capacitor to the speaker to reduce an influence of the test current on a tone of the sound outputted from the speaker.

2. The failure detection device according to claim 1, wherein the sound signal includes an audible sound signal that causes the speaker to output an audible operation notification sound for notifying that the vehicle is in an operating state.

3. The failure detection device according to claim 1, wherein the supply circuit is supplied with power when the vehicle is in an activation state, and the supply circuit produces the test current from the power.

4. The failure detection device according to claim 1, wherein the determination section compares the terminal voltage with a predetermined threshold voltage, and when the terminal voltage achieves a predetermined relationship with respect to the threshold voltage, the determination section determines that the at least one of the open-circuit and the short-circuit occurs in the speaker.

5. The failure detection device according to claim 4 wherein the determination section determines that the at least one of the open-circuit and the short-circuit occurs in the speaker, when the predetermined relationship continues for a predetermined time period.

6. The failure detection device according to claim 1, further comprising:

a controller having an input port with a function of detecting a level of an input signal, wherein the determination section compares the terminal voltage with a predetermined threshold voltage by using the function.

7. The failure detection device according to claim 1 wherein the determination section includes a comparator for comparing the terminal voltage with a predetermined threshold voltage.

8. The failure detection device according to claim 1 wherein the supply circuit, the detection circuit, and the determination section are integrated together to form an integrated circuit.

9. The failure detection device according to claim 1, further comprising:

a controller for performing a predetermined computation, wherein the determination section compares the terminal voltage with a predetermined threshold voltage by using the computation.

10. The failure detection device according to claim 9, wherein the controller has an input port for receiving the terminal voltage, and the detection circuit has a diode for removing a negative voltage applied to the input port.

11. The failure detection device according to claim 1, further comprising:

a monitor section, wherein the supply circuit is supplied with a variable voltage and produces the test current from the variable voltage, and the monitor section masks a determination signal outputted from the determination section when the variable voltage is reduced below a predetermined lower limit value.

* * * * *